US007387582B2

(12) United States Patent
Sajima

(10) Patent No.: US 7,387,582 B2
(45) **Date of Patent: *Jun. 17, 2008**

(54) GOLF BALL

(75) Inventor: Takahiro Sajima, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/129,366

(22) Filed: May 16, 2005

(65) Prior Publication Data

US 2006/0009311 A1 Jan. 12, 2006

(30) Foreign Application Priority Data

Jul. 8, 2004 (JP) ..... 2004-201312

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,813,677 A 3/1989 Oka et al.
5,072,945 A * 12/1991 Oka et al. ..... 473/384
5,292,132 A 3/1994 Oka
6,508,723 B1 * 1/2003 Shimosaka ..... 473/351
6,558,274 B1 * 5/2003 Shimosaka ..... 473/351
7,112,149 B2 * 9/2006 Sajima et al. ..... 473/383
2004/0132551 A1 * 7/2004 Aoyama et al. ..... 473/378
2005/0101412 A1 * 5/2005 Sajima et al. ..... 473/378
2005/0107189 A1 * 5/2005 Ohama et al. ..... 473/371
2006/0025244 A1 * 2/2006 Yokota et al. ..... 473/378

FOREIGN PATENT DOCUMENTS

GB 2370996 A 7/2002

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has dimples A having a diameter of 5.15 mm, dimples B having a diameter of 5.00 mm, dimples C having a diameter of 4.60 mm, dimples D having a diameter of 4.50 mm, dimples E having a diameter of 4.20 mm, dimples F having a diameter of 4.10 mm, dimples G having a diameter of 3.90 mm and dimples H having a diameter of 3.00 mm. Mean value of the diameter of all the dimples 8 is equal to or greater than 4.00 mm. Standard deviation η of the diameter of all the dimples 8 is 0.52 or greater and 0.72 or less. Occupation ratio of total area of the dimples in the surface area of the phantom sphere is equal to or greater than 75%.

4 Claims, 20 Drawing Sheets

A
B
A
B
A
B

GOLF BALL

This application claims priority on Patent Application No. 2004-201312 filed in JAPAN on Jul. 8, 2004, the entire contents of which are hereby incorporated by reference.

BACKGROUND OF THE INVENTION

1. Field of the Invention

The present invention relates to golf balls. More particularly, the present invention relates to improvement of dimples of a golf ball.

2. Description of the Related Art

Golf balls have numerous dimples on the surface thereof. The dimples cause turbulent flow separation through disrupting the air flow around the golf ball during the flight. By causing the turbulent flow separation, a separating point of air from the golf ball shifts backwards leading to the reduction of a drag. The turbulent flow separation promotes the differentia between upper separating point and lower separating point of the golf ball, which results from the backspin, thereby enhancing the lift force that acts upon the golf ball. Reduction of the drag and enhancement of the lift force is referred to as "dimple effect". Excellent dimples disturb the air flow more efficiently.

A variety of proposals with respect to dimples in an attempt to improve flight performances have been made. U.S. Pat. No. 5,292,132 discloses a golf ball having dimples arranged with an extremely high density. U.S. Pat. No. 4,813,677 discloses a golf ball having a dimple pattern in which dimples having a great diameter and dimples having a small diameter are provided in combination. GB 2370996A discloses a golf ball having dimples with a great size.

Top concern to golf players for golf balls is the travel distance. In light of elevation of the travel distance, there remains room for an improvement of the dimples. An object of the present invention is to provide a golf ball that is excellent in the flight performance.

SUMMARY OF THE INVENTION

The golf ball according to the present invention has three or more kinds of dimples, each having a different diameter, on the surface thereof. Occupation ratio of total area of the dimples in the surface area of the phantom sphere is equal to or greater than 75%. Mean value of the diameter of all the dimples is equal to or greater than 4.00 mm. Standard deviation $\eta$ of the diameter of all the dimples is 0.52 or greater and 0.72 or less.

Preferably, ratio (Dx/Dn) in this golf ball is equal to or less than 1.70. Dx is a mean diameter of the dimples ranking in the top 10%, when all the dimples are arranged in decreasing order of the diameter. Dn is a mean diameter of the dimples ranking in the bottom 10%, when all the dimples are arranged in decreasing order of the diameter.

Preferably, this golf ball has 5 or more kinds of dimples, each having a different diameter, on the surface thereof.

According to this golf ball, great standard deviation $\eta$ is responsible for the reduction of a drag. This golf ball is excellent in flight performances.

DESCRIPTION OF THE PREFERRED EMBODIMENTS

The present invention is hereinafter described in detail with appropriate references to the accompanying drawing according to the preferred embodiments of the present invention.

Figure 1:
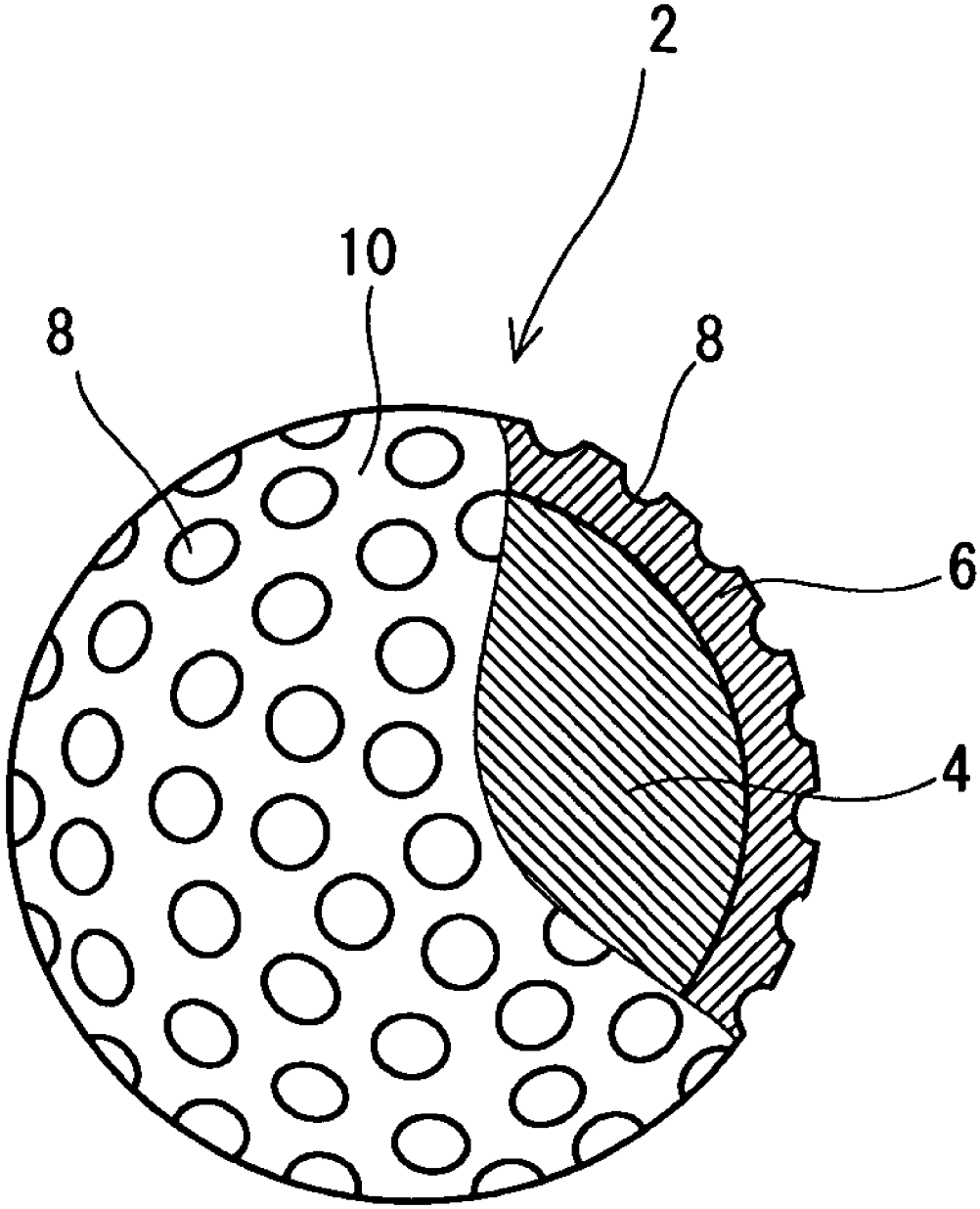
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, part other than the dimples 8 is a land 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 4, a co-crosslinking agent is usually used. Preferable examples of the co-crosslinking agent in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended in an appropriate amount into the rubber composition of the core 4 as needed. Crosslinked rubber powder or synthetic resin powder may be blended into the rubber composition.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers.

Polymer that is suitable for the cover 6 is an ionomer resin. In particular, a copolymer of α-olefin and an α,β-unsaturated carboxylic acid having 3 to 8 carbon atoms in which a part of the carboxylic acid is neutralized with a metal ion is suitable. Examples of preferable α-olefin include ethylene and propylene. Examples of preferable α,β-unsaturated carboxylic acid include acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, examples of suitable metal ion include sodium ion, zinc ion, lithium ion and magnesium ion.

Other polymer may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be blended with powder of a highly dense metal such as tungsten, molybdenum or the like for the purpose of adjusting the specific gravity.

The cover 6 has a thickness of equal to or greater than 0.5 mm, and particularly equal to or greater than 0.8 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
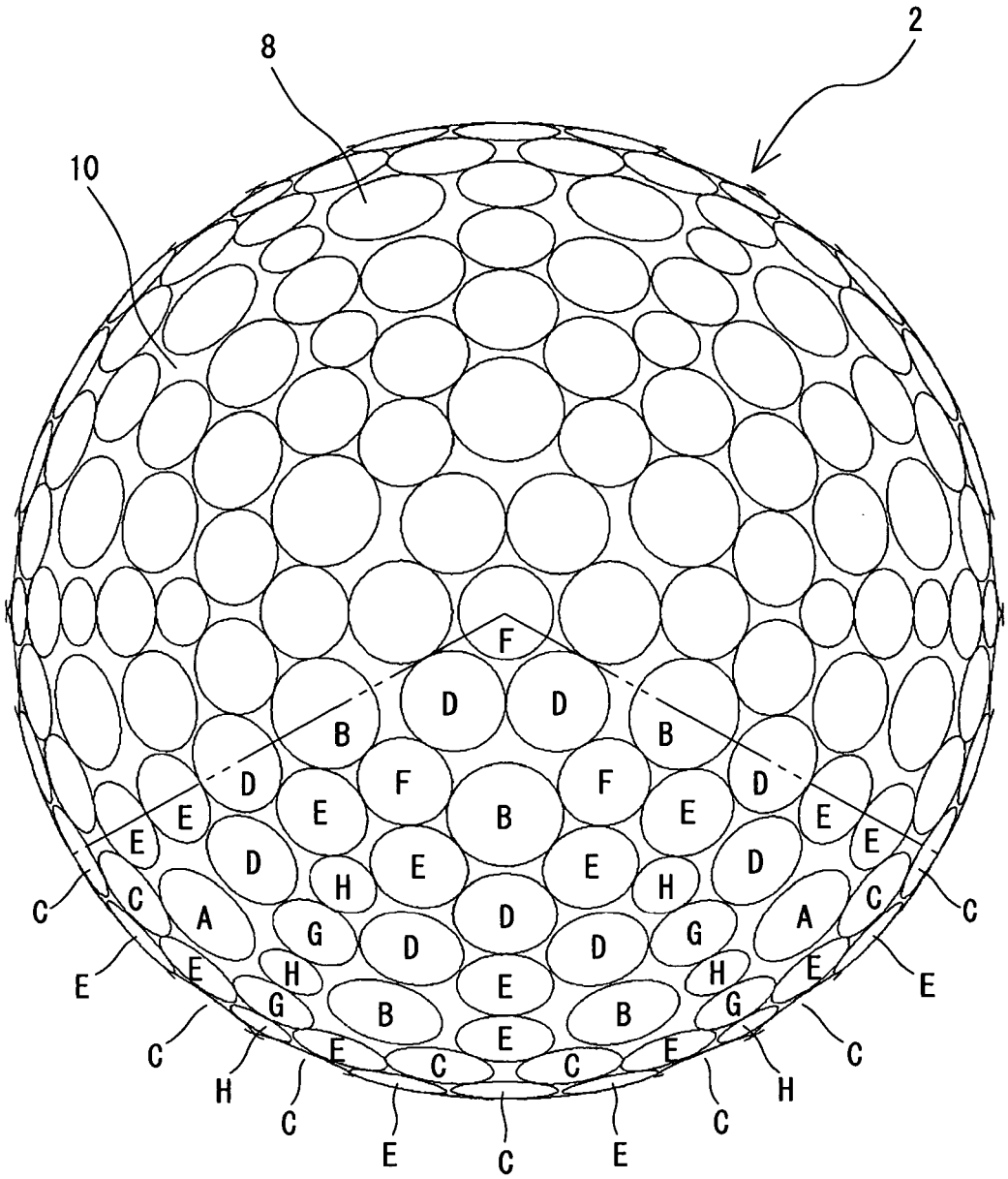
FIG. 2 is an enlarged plan view illustrating the golf ball shown in FIG. 1.
Figure 3:
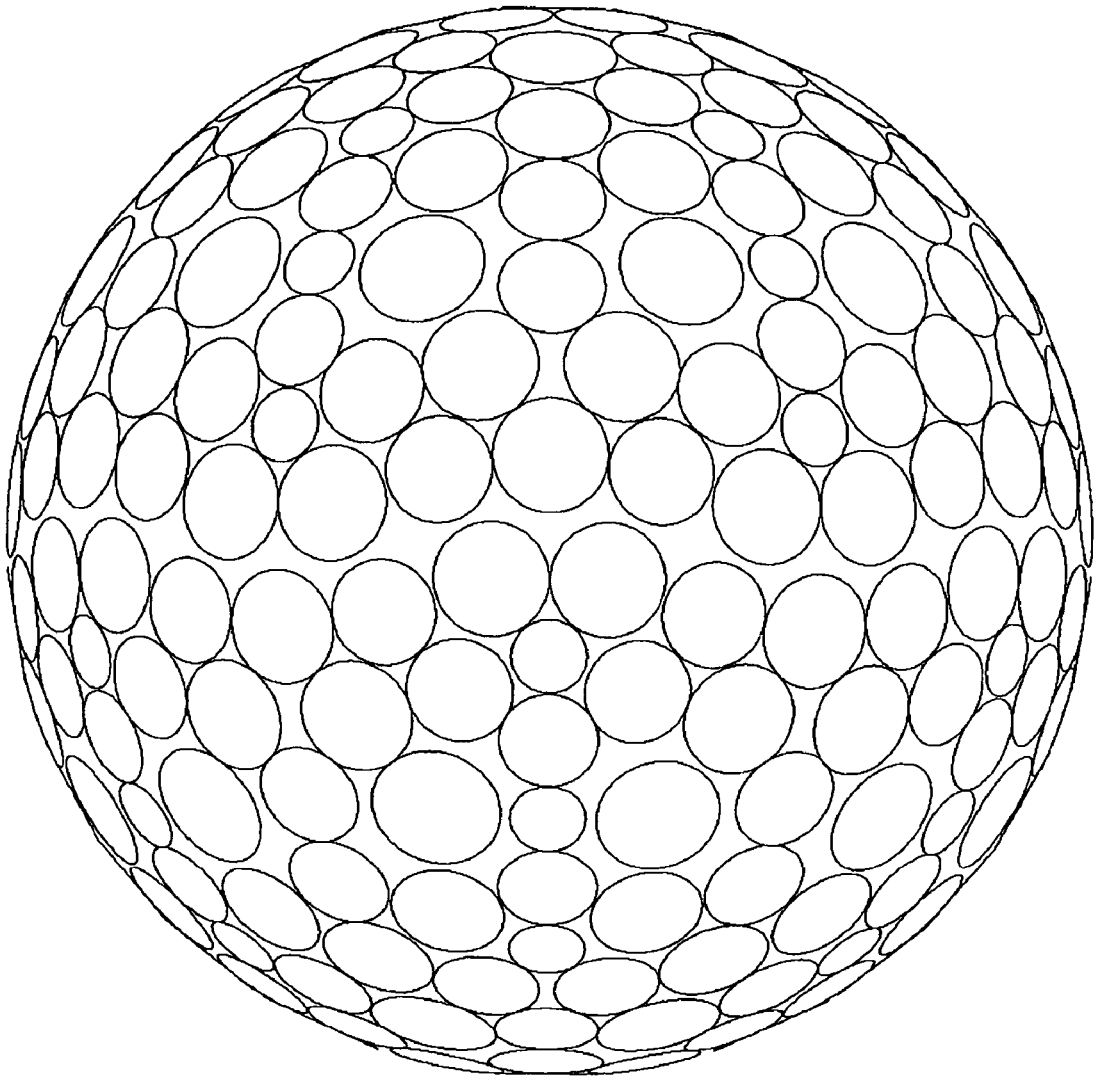
FIG. 3 is a front view illustrating the golf ball shown in FIG. 2.

FIG. 2 is an enlarged plan view illustrating the golf ball 2 shown in FIG. 1; and FIG. 3 is a front view illustrating the golf ball 2 shown in FIG. 2. As is clear from FIG. 2 and FIG. 3, the plane shape of all the dimples 8 is circular. In FIG. 2, kinds of the dimples 8 are illustrated by symbols of A to H in one unit, which is provided when the surface of the golf ball 2 is comparted into six equivalent units. This golf ball 2 has dimples A having a diameter of 5.15 mm, dimples B having a diameter of 5.00 mm, dimples C having a diameter of 4.60 mm, dimples D having a diameter of 4.50 mm, dimples E having a diameter of 4.20 mm, dimples F having a diameter of 4.10 mm, dimples G having a diameter of 3.90 mm and dimples H having a diameter of 3.00 mm. Through the combination of multiple kinds of dimples 8, each having a different diameter, the air flow is more efficiently disrupted, thereby reducing the drag. In light of reduction of the drag, it is necessary to provide three or more kinds of dimples 8. It is preferred that 5 or more kinds, yet 6 or more kinds, and particularly 7 or more kinds of dimples 8 are provided. In light of ease of production of the mold, 20 or less kinds of dimples 8 are preferably provided. The golf ball 2 shown in FIG. 2 and FIG. 3 has 8 kinds of dimples 8 designated as A to H.

Even though dimples 8 are designed such that they have the same diameter, there may be a case in which found values obtained by the actual measurement of the diameter are different to some extent due to the error caused during the production. According to the present invention, dimples that exhibit the difference from the value intended in the design being less than 0.05 mm are regarded to fall within the same kind.

According to the golf ball 2 shown in FIG. 2 and FIG. 3, the number of the dimples A is 12; the number of the dimples B is 24; the number of the dimples C is 60; the number of the dimples D is 48; the number of the dimples E is 96; the number of the dimples F is 14; the number of the dimples G is 24; and the number of the dimples H is 36. Total number of the dimples 8 of this golf ball 2 is 314.

Figure 4:
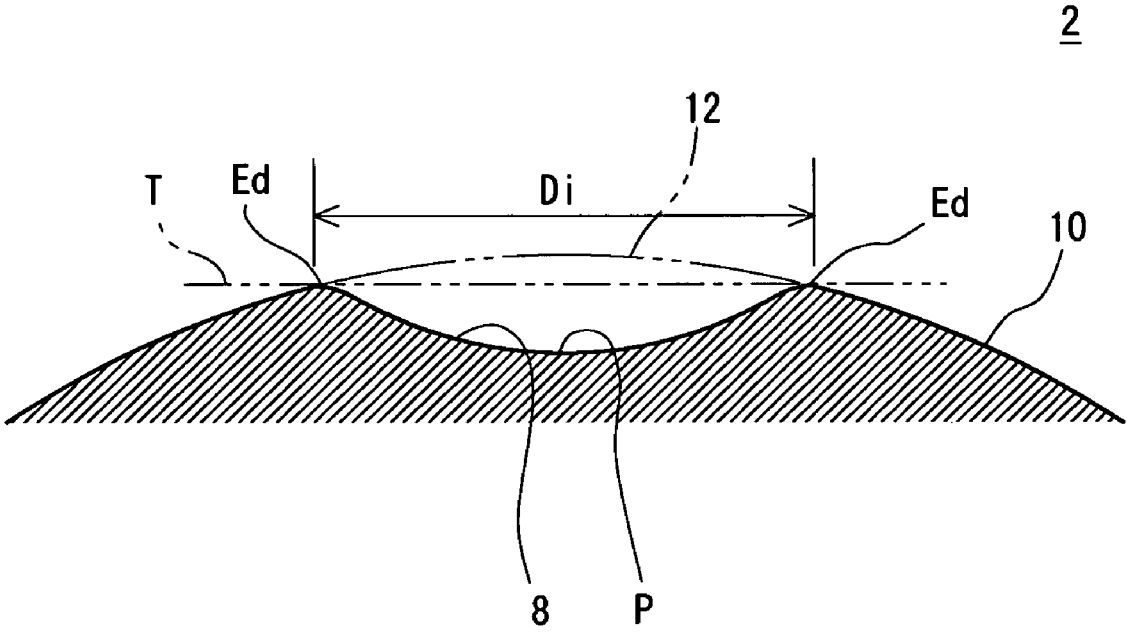
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this Figure, a cross section along a plane passing through a deepest place P of the dimple 8 and the center of the golf ball 2 is shown. A top-to-bottom direction in FIG. 4 is an in-depth direction of the dimple 8. The in-depth direction is a direction from the weighted center of area of the dimple 8 toward the center of the golf ball 2. What is indicated by a chain double-dashed line 12 in FIG. 4 is a phantom sphere. The surface of the phantom sphere 12 corresponds to a surface of the golf ball 2 when it is postulated that there is no dimple 8 existed. The dimple 8 is recessed from the phantom sphere 12. The land 10 agrees with the phantom sphere 12.

What is indicated by a both-sided arrowhead Di in FIG. 4 is the diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 2.00 mm or greater and 6.0 mm or less. When the diameter Di is less than the above range, the dimple effect is hardly achieved. In this respect, the diameter Di is more preferably equal to or greater than 2.20 mm, and particularly preferably equal to or greater than 2.40 mm. When the diameter Di is beyond the above range, fundamental feature of the golf ball 2 which is substantially a sphere may be compromised. In this respect, the diameter Di is more preferably equal to or less than 5.8 mm, and particularly preferably equal to or less than 5.6 mm.

It is preferred that mean value Da of the diameters Di of all the dimples 8 is equal to or greater than 4.00 mm. A dimple pattern in which the mean value Da is equal to or greater than 4.00 mm results in more efficient disruption of air flow. In this respect, the mean value Da is more preferably equal to or greater than 4.10 mm, and particularly preferably equal to or greater than 4.20 mm. When the mean value Da is too great, fundamental feature of the golf ball 2 which is substantially a sphere may be compromised. In this respect, the mean value Da is preferably equal to or less than 5.00 mm, and more preferably equal to or less than 4.80 mm. The mean value Da in the golf ball 2 shown in FIG. 2 to FIG. 4 is calculated by the following formula:

$$Da=(5.15*12+5.00*24+4.60*60+4.50*48+4.20*96+4.10*14+3.90*24+3.00*36)/314.$$

The mean value Da of this golf ball 2 is 4.26 mm.

Standard deviation η of the diameters Di for all the dimples 8 is equal to or greater than 0.52. In other words, fluctuation of frequency distribution of diameters of the dimples 8 is found in this golf ball 2. Due to the great standard deviation η, air flow is efficiently disturbed according to this golf ball 2. The drag is reduced according to this golf ball 2. This golf ball 2 is excellent in flight performances. In light of the flight performance, the standard deviation η is preferably equal to or greater than 0.55, and particularly preferably equal to or greater than 0.60. When the standard deviation η is excessively great, dimple effect is hardly achieved. In this respect, the standard deviation η is required to be less than 0.72. The standard deviation η is more preferably equal to or less than 0.70, and particularly preferably equal to or less than 0.67. Because the mean value Da of the diameters Di in the golf ball 2 shown in FIG. 2 and FIG. 3 is 4.26 as described above, the standard deviation η in this golf ball 2 is calculated by the following formula:

$$\eta = (((5.15-4.26)^2*12+(5.00-4.26)^2*24+(4.60-4.26)^2*60+(4.50-4.26)^2*48+(4.20-4.26)^2*96+(4.10-4.26)^2*14+(3.90-4.26)^2*24+(3.00-4.26)^2*36)/314)^{1/2}.$$

The standard deviation q in this golf ball 2 is 0.55.

Area s of the dimple 8 is an area of a region surrounded by the edge line when the center of the golf ball 2 is viewed at infinity. The area s is calculated by the following formula:

$$s=(Di/2)^2*\pi.$$

In the golf ball 2 shown in FIG. 2 and FIG. 3, the area of the dimple A is 20.83 $mm^2$; the area of the dimple B is 19.63 $mm^2$; the area of the dimple C is 16.62 $mm^2$; the area of the dimple D is 15.90 $mm^2$; the area of the dimple E is 13.85 $mm^2$; the area of the dimple F is 13.20 $mm^2$; the area of the dimple G is 11.95 $mm^2$; and the area of the dimple H is 7.07 $mm^2$.

According to the present invention, ratio of sum total of areas s of all the dimples 8 occupying the surface area of the phantom sphere 12 is referred to as an occupation ratio. From the standpoint that a sufficient dimple effect is achieved, the occupation ratio is preferably equal to or greater than 75%, more preferably equal to or greater than 77%, and particularly preferably equal to or greater than 79%. The occupation ratio is usually equal to or less than 90%. According to the golf ball 2 shown in FIG. 2 and FIG. 3, total area of the dimples 8 is 4537.8 $mm^2$. Because the surface area of the phantom sphere 12 of this golf ball 2 is 5728.0 $mm^2$, the occupation ratio is 79.2%.

According to the present invention, a mean diameter of the dimples 8 ranking in the top 10%, when all the dimples 8 are arranged in decreasing order of the diameter Di, is represented by Dx (mm). Because total number of the dimples 8 of the golf ball 2 shown in FIG. 2 and FIG. 3 is 314, a mean diameter of the dimples 8 ranking in the top 31 is represented by Dx (mm) in this golf ball 2. As described above, this golf ball 2 has 12 dimples A having the diameter Di of 5.15 mm, and 24 dimples B having the diameter Di of 5.00 mm. Thus, dimples A shall fall under the "dimples ranking in the top 10%". Also, 19 dimples among the dimples B shall fall under the "dimples ranking in the top 10%". Dx of this golf ball 2 is calculated by the following formula:

$$Dx=(5.15*12+5.00*19)/31.$$

According to this golf ball 2, Dx is 5.06 mm.

According to the present invention, a mean diameter of the dimples 8 ranking in the bottom 10%, when all the dimples 8 are arranged in decreasing order of the diameter Di, is represented by Dn (mm). Because total number of the dimples 8 of the golf ball 2 shown in FIG. 2 and FIG. 3 is 314, a mean diameter of the dimples 8 ranking in the bottom 31 is represented by Dn (mm) in this golf ball 2. As described above, this golf ball 2 has 36 dimples H having the diameter Di of 3.00 mm. Thus, 31 dimples among the dimples H shall also fall under the "dimples ranking in the bottom 10%". According to this golf ball 2, Dn is 3.00 mm.

As described above, this golf ball 2 has Dx of 5.06 mm, and Dn of 3.00 mm. In this golf ball 2, the ratio (Dx/Dn) is 1.69. This ratio (Dx/Dn) is comparatively small. The dimple pattern having the small ratio (Dx/Dn) is responsible for enhancement of the lift force. In this golf ball 2, excellent flight performances are achieved due to a synergistic effect of the great standard deviation η and the small ratio (Dx/Dn). In light of the flight performances, the ratio (Dx/Dn) is preferably equal to or less than 1.70, and more preferably equal to or less than 1.68 and particularly preferably equal to or less than 1.63. When the ratio (Dx/Dn) is too small, the drag is not sufficiently reduced. In this respect, the ratio (Dx/Dn) is more preferably equal to or greater than 1.30, and particularly preferably equal to or greater than 1.33.

In FIG. 4, a distance between the tangent line T and the deepest place P is the depth of the dimple 8. It is preferred that the depth is 0.05 mm or greater and 0.60 mm or less. When the depth is less than the above range, a hopping trajectory of the golf ball 2 is liable to be provided. In this respect, the depth is more preferably equal to or greater than 0.08 mm, and particularly preferably equal to or greater than 0.10 mm. When the depth is beyond than the above range, a dropping trajectory of the golf ball 2 is liable to be provided. In this respect, the depth is more preferably equal to or less than 0.45 mm, and particularly preferably equal to or less than 0.40 mm.

According to the present invention, "volume of the dimple" means a volume surrounded by a plane including the contour of the dimple 8 and the surface of the dimple 8. It is preferred that total volume of the dimples 8 is 250 $mm^3$ or greater and 400 $mm^3$ or less. When the total volume is less than the above range, a hopping trajectory of the golf ball 2 is liable to be provided. In this respect, the total volume is more preferably equal to or greater than 260 $mm^3$, and particularly preferably equal to or greater than 270 $mm^3$.

When the total volume is beyond the above range, a dropping trajectory of the golf ball 2 is liable to be provided. In this respect, the total volume is more preferably equal to or less than 390 $mm^3$, and particularly preferably equal to or less than 380 $mm^3$.

It is preferred that total number of the dimples 8 is 200 or greater and 500 or less. When the total number is less than the above range, achievement of the dimple effect may be difficult. In this respect, the total number is more preferably equal to or greater than 240, and particularly preferably equal to or greater than 260. When the total number is beyond the above range, achievement of the dimple effect may be difficult due to small size of the individual dimples 8. In this respect, the total number is more preferably equal to or less than 480, and particularly preferably equal to or less than 460.

Cross sectional shape of the dimple 8 may be of either single radius or double radius. The dimple 8 may also have other cross sectional shape.

EXAMPLES

Example 1

A rubber composition was obtained by kneading 100 parts by weight of polybutadiene (trade name "BR-11", available from JSR Corporation), 24.5 parts by weight of zinc diacrylate, 10 parts of zinc oxide, 15 parts by weight of barium sulfate and 0.8 part by weight of dicumyl peroxide. This rubber composition was placed into a mold having upper and lower mold half each having a hemispherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts of titanium dioxide. The aforementioned core was placed into a mold having numerous protrusions on the inner surface, followed by the injection of the aforementioned resin composition around the core according to an injection molding method to form a cover having a thickness of 2.3 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball has a compression (ATTI) of about 85. Specifications of the dimples of this golf ball are presented in Table 1 below.

Examples 2 to 4 and Comparative Examples 1 to 5

In a similar manner to Example 1 except that the mold was changed to alter specifications of the dimples as presented in Table 1 and Table 2 below, golf balls of Examples 2 to 4 and Comparative Examples 1 to 5 were obtained.

TABLE 1

Figure 5:
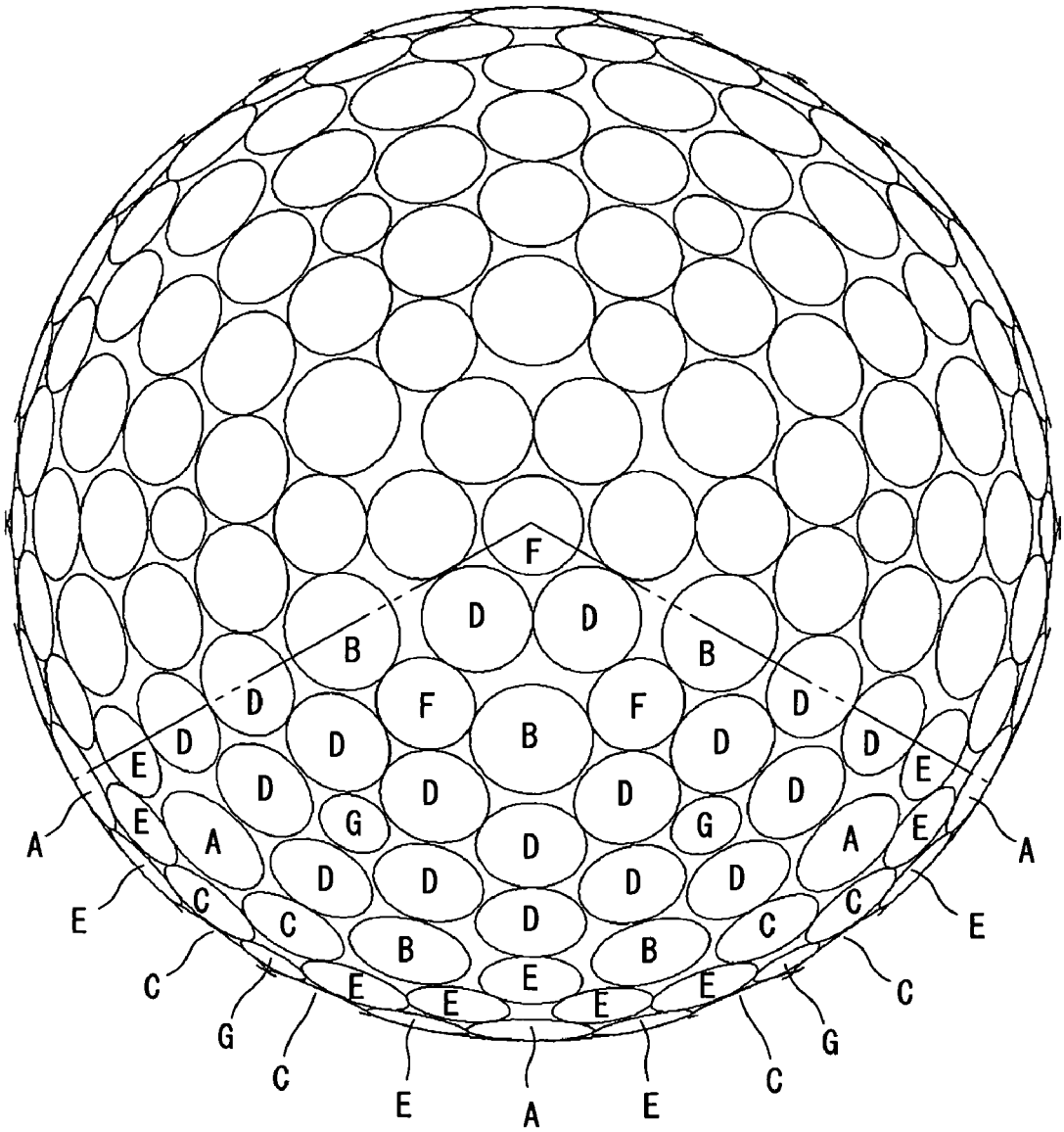
FIG. 5 is a plan view illustrating a golf ball according to Example 2 of the present invention.
Figure 6:
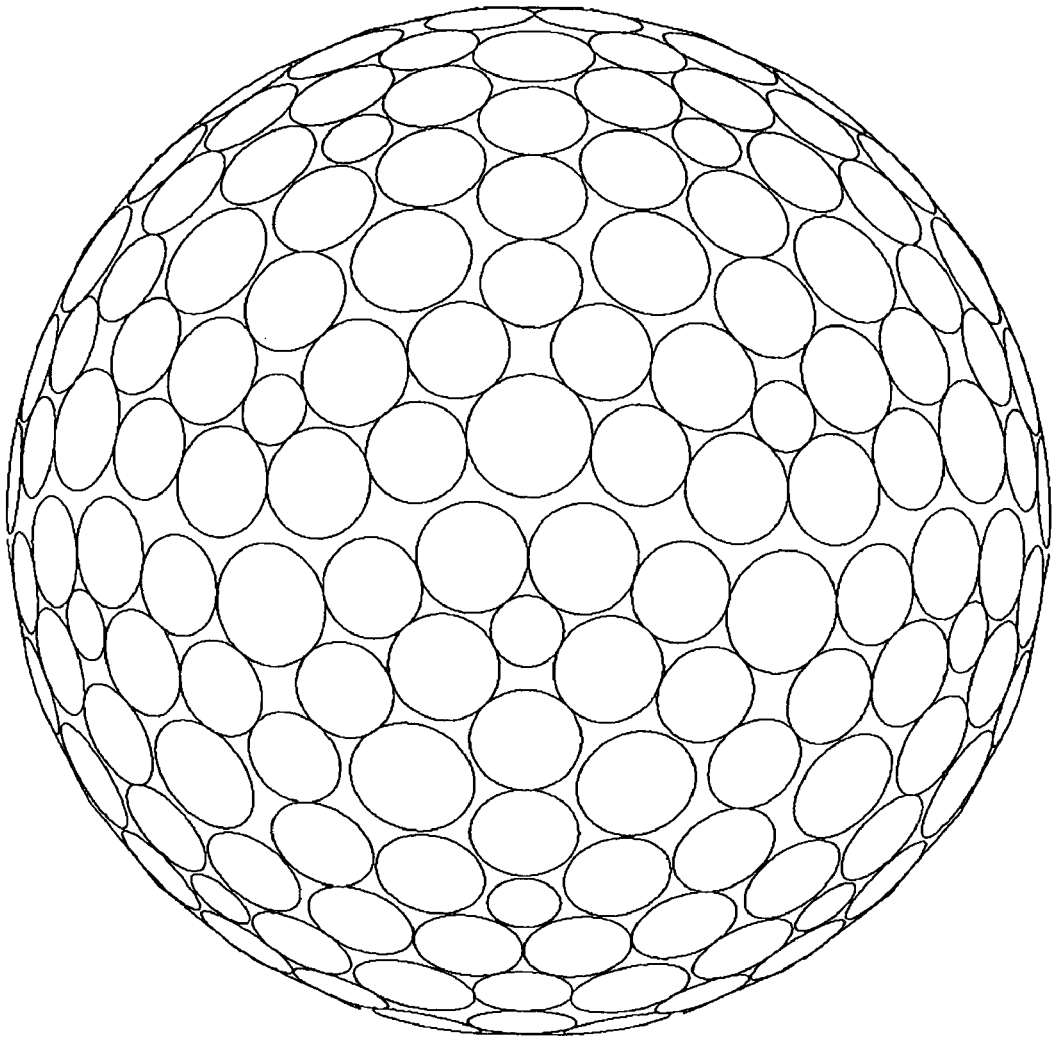
FIG. 6 is a front view illustrating the golf ball shown in FIG. 5.
Figure 7:
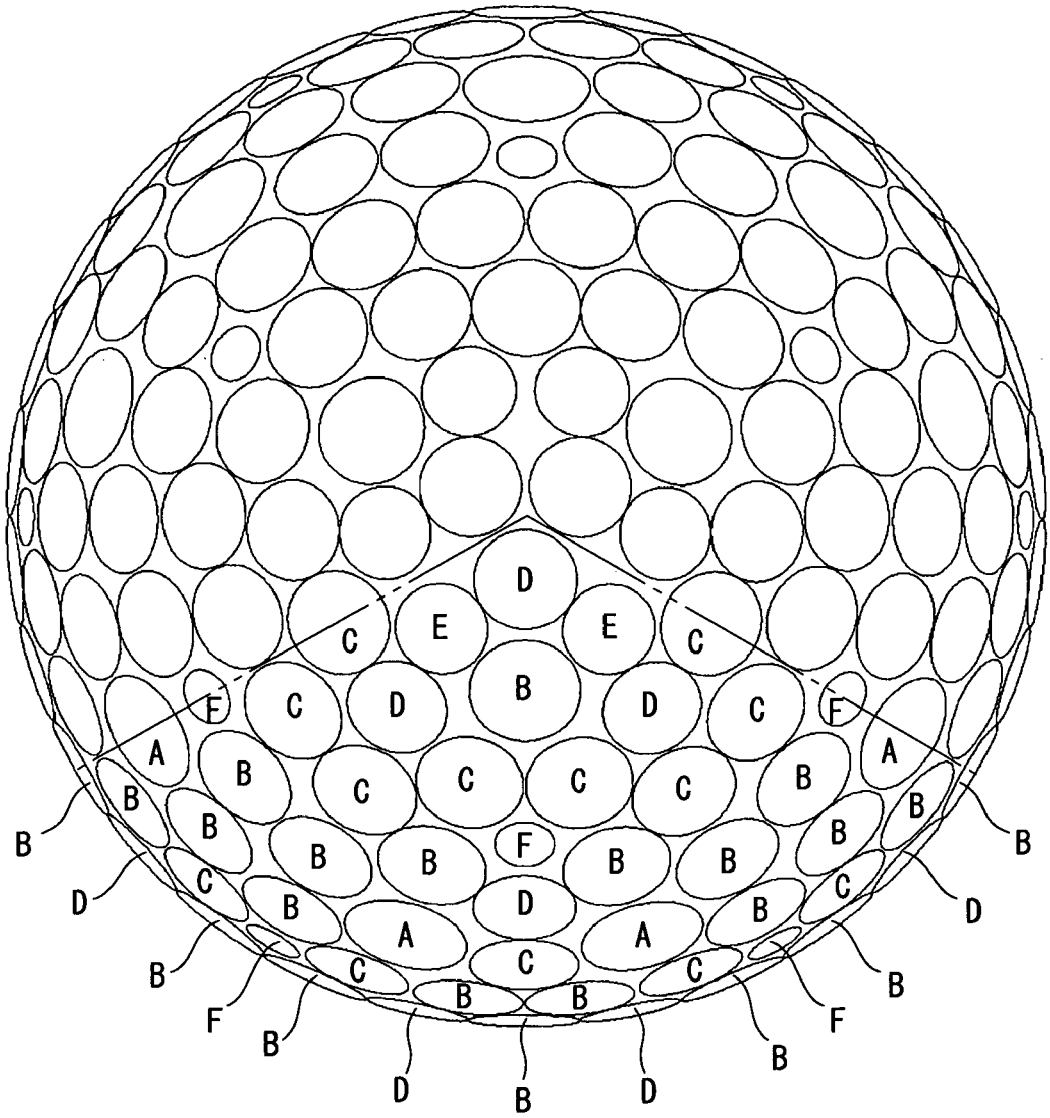
FIG. 7 is a plan view illustrating a golf ball according to Example 3 of the present invention.
Figure 8:
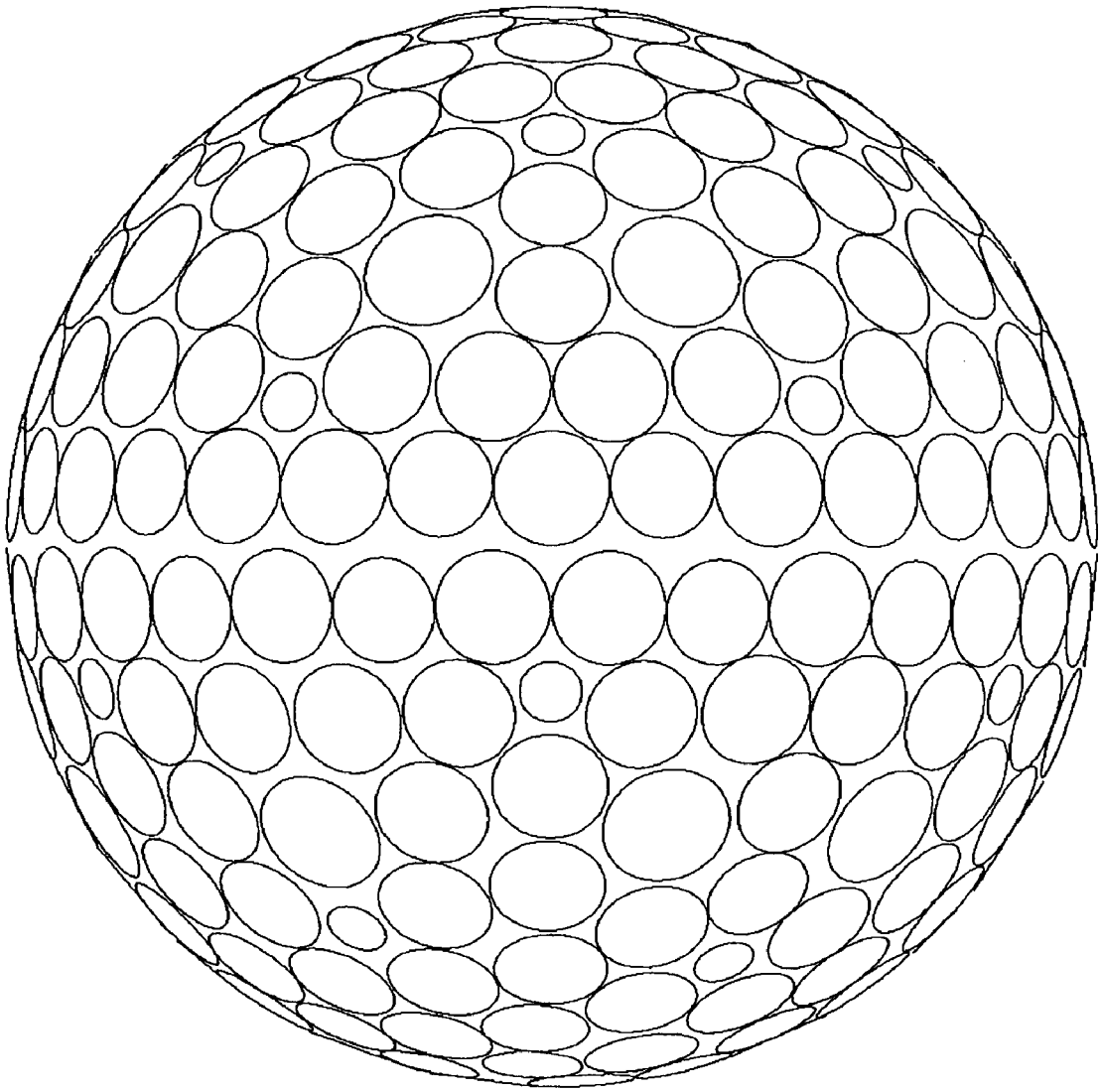
FIG. 8 is a front view illustrating the golf ball shown in FIG. 7.
Figure 9:
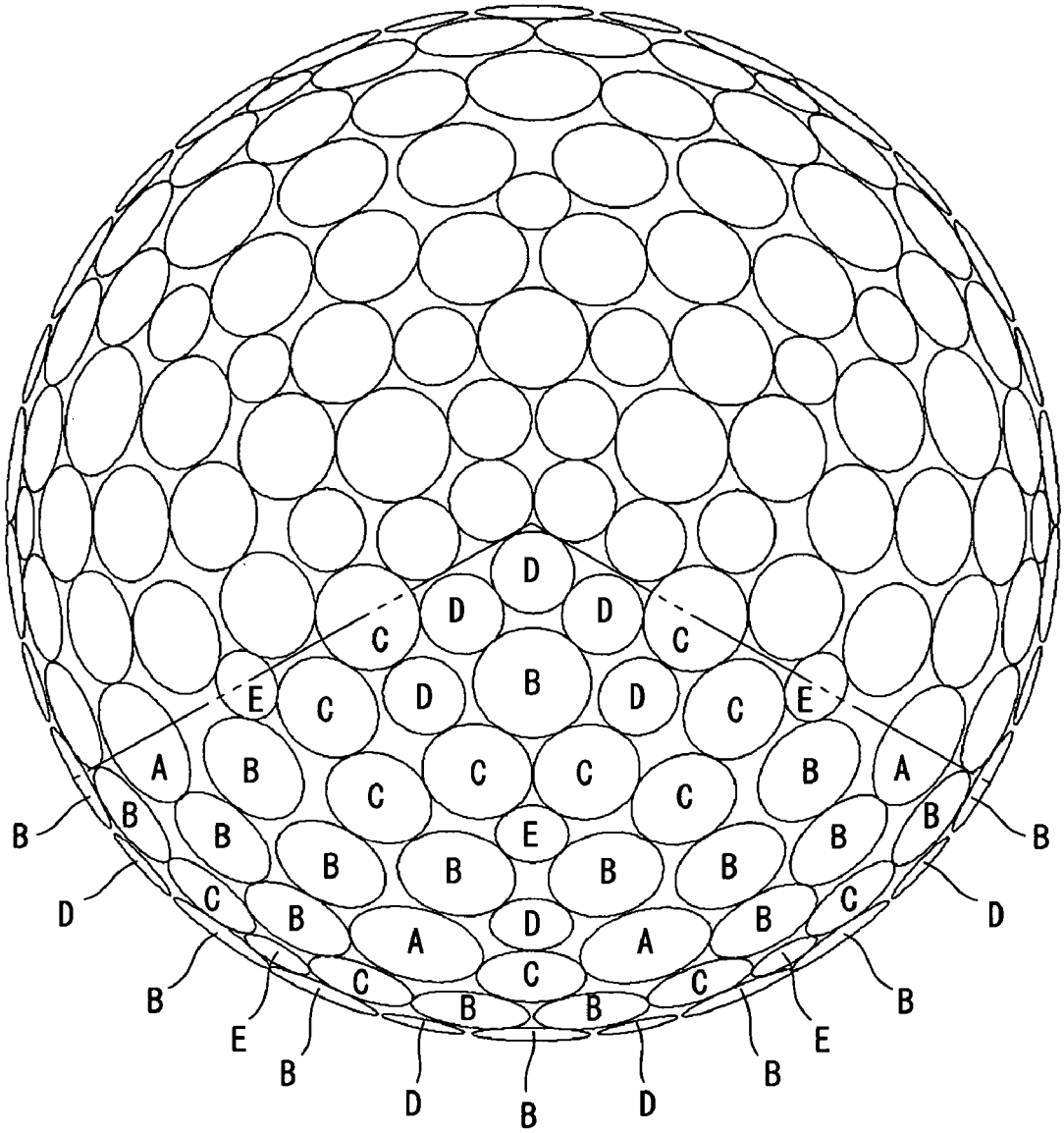
FIG. 9 is a plan view illustrating a golf ball according to Example 4 of the present invention.
Figure 10:
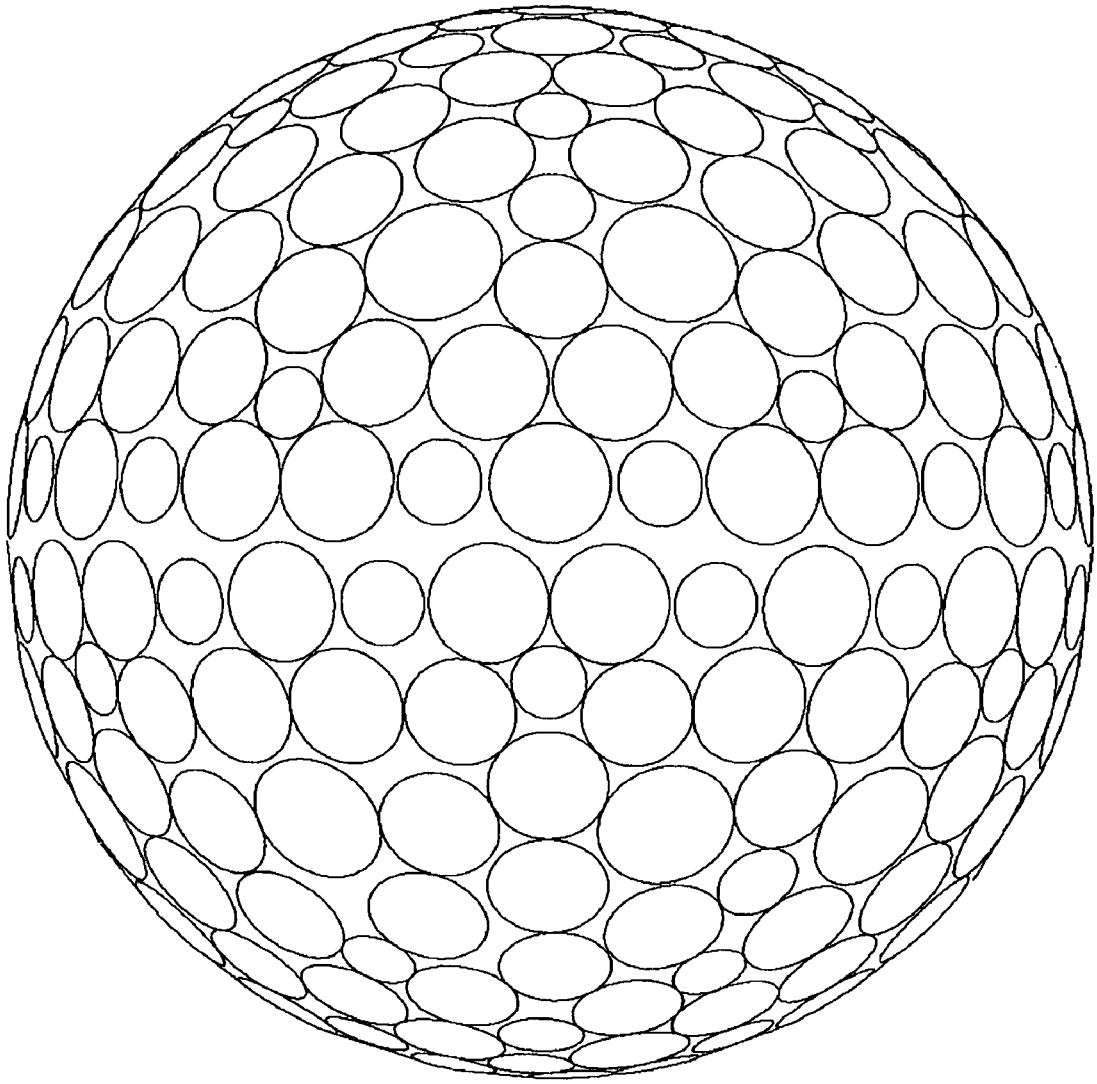
FIG. 10 is a front view illustrating the golf ball shown in FIG. 9.

| | Specification of dimples | | | | | | | |
|---|---|---|---|---|---|---|---|---|
| | Kind | Number | Diameter (mm) | Depth (mm) | Curvature radius (mm) | Volume ($mm^3$) | Plan view | Front view |
| Example 1 | A | 12 | 5.15 | 0.135 | 24.63 | 1.407 | FIG. 2 | FIG. 3 |
| | B | 24 | 5.00 | 0.135 | 23.22 | 1.327 | | |
| | C | 60 | 4.60 | 0.140 | 18.96 | 1.165 | | |
| | D | 48 | 4.50 | 0.140 | 18.15 | 1.115 | | |
| | E | 96 | 4.20 | 0.135 | 16.40 | 0.936 | | |
| | F | 14 | 4.10 | 0.135 | 15.63 | 0.892 | | |
| | G | 24 | 3.90 | 0.135 | 14.15 | 0.808 | | |
| | H | 36 | 3.00 | 0.127 | 8.92 | 0.450 | | |
| Example 2 | A | 24 | 5.15 | 0.130 | 25.57 | 1.355 | FIG. 5 | FIG. 6 |
| | B | 24 | 5.00 | 0.130 | 24.10 | 1.277 | | |
| | C | 60 | 4.60 | 0.135 | 19.66 | 1.123 | | |
| | D | 96 | 4.50 | 0.135 | 18.82 | 1.075 | | |
| | E | 60 | 4.20 | 0.130 | 17.03 | 0.902 | | |
| | F | 14 | 4.10 | 0.130 | 16.23 | 0.859 | | |
| | G | 24 | 2.90 | 0.130 | 8.15 | 0.430 | | |
| Example 3 | A | 8 | 5.15 | 0.140 | 23.75 | 1.460 | FIG. 7 | FIG. 8 |
| | B | 126 | 4.56 | 0.140 | 18.64 | 1.145 | | |
| | C | 72 | 4.46 | 0.138 | 18.09 | 1.079 | | |
| | D | 48 | 4.21 | 0.136 | 16.36 | 0.948 | | |
| | E | 12 | 3.90 | 0.132 | 14.47 | 0.790 | | |
| | F | 24 | 2.45 | 0.120 | 6.31 | 0.284 | | |
| Example 4 | A | 18 | 5.50 | 0.137 | 27.67 | 1.629 | FIG. 9 | FIG. 10 |
| | B | 126 | 4.80 | 0.137 | 21.09 | 1.241 | | |
| | C | 72 | 4.46 | 0.136 | 18.35 | 1.064 | | |
| | D | 60 | 3.40 | 0.135 | 10.77 | 0.614 | | |
| | E | 24 | 3.00 | 0.130 | 8.72 | 0.461 | | |

TABLE 2

Specification of dimples

Figure 11:
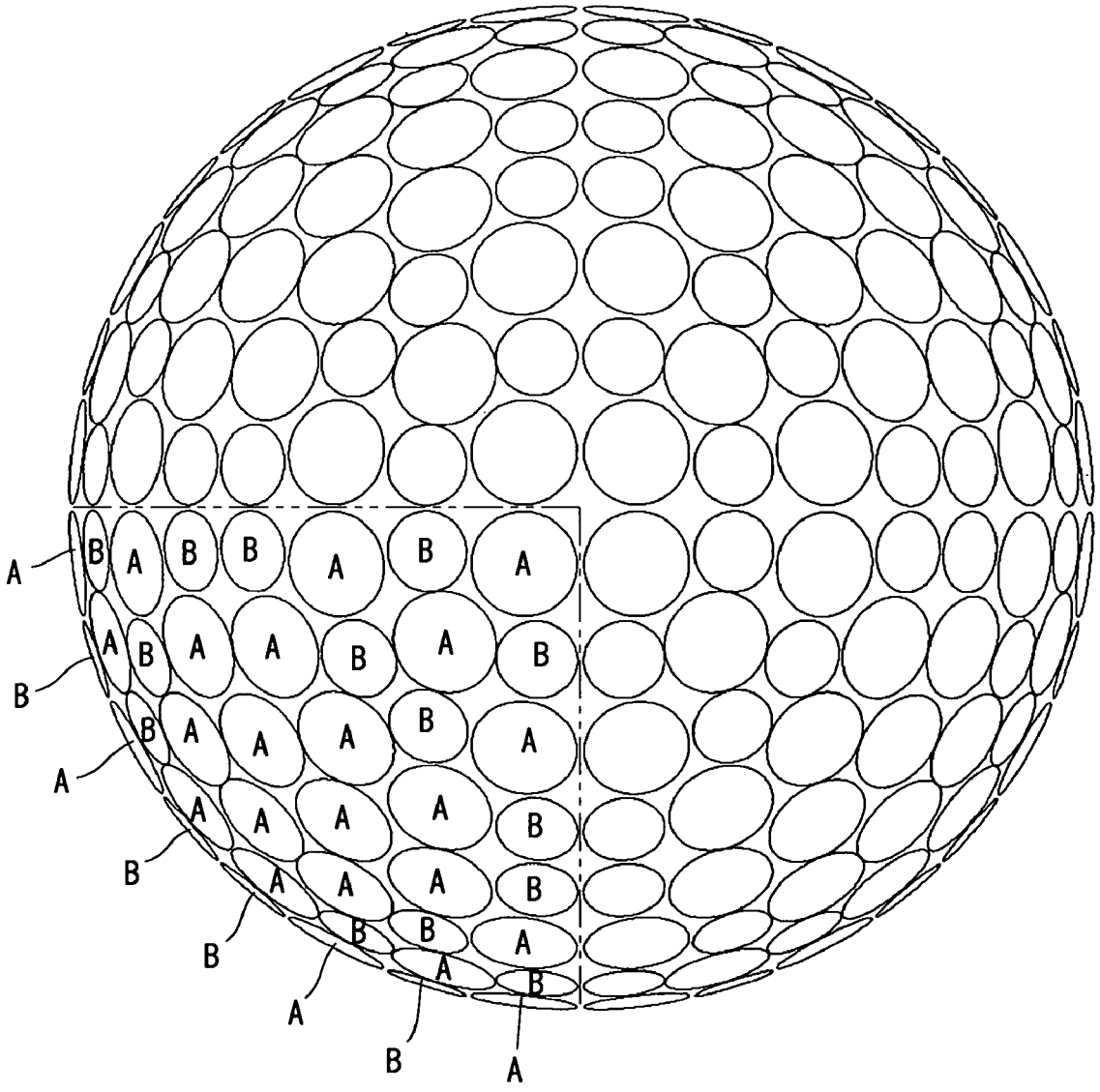
FIG. 11 is a plan view illustrating a golf ball according to Comparative Example 1.
Figure 12:
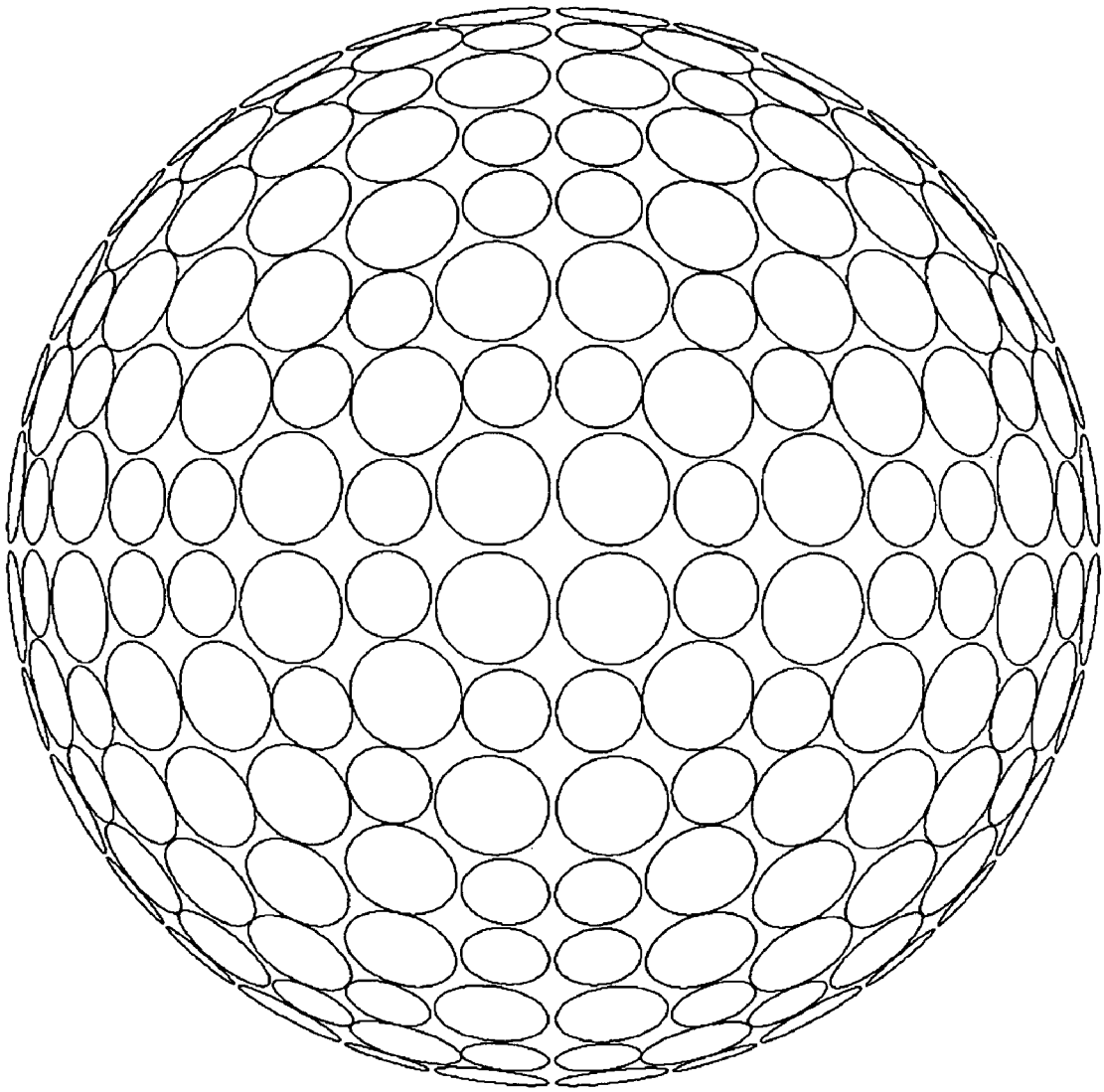
FIG. 12 is a front view illustrating the golf ball shown in FIG. 11.
Figure 13:
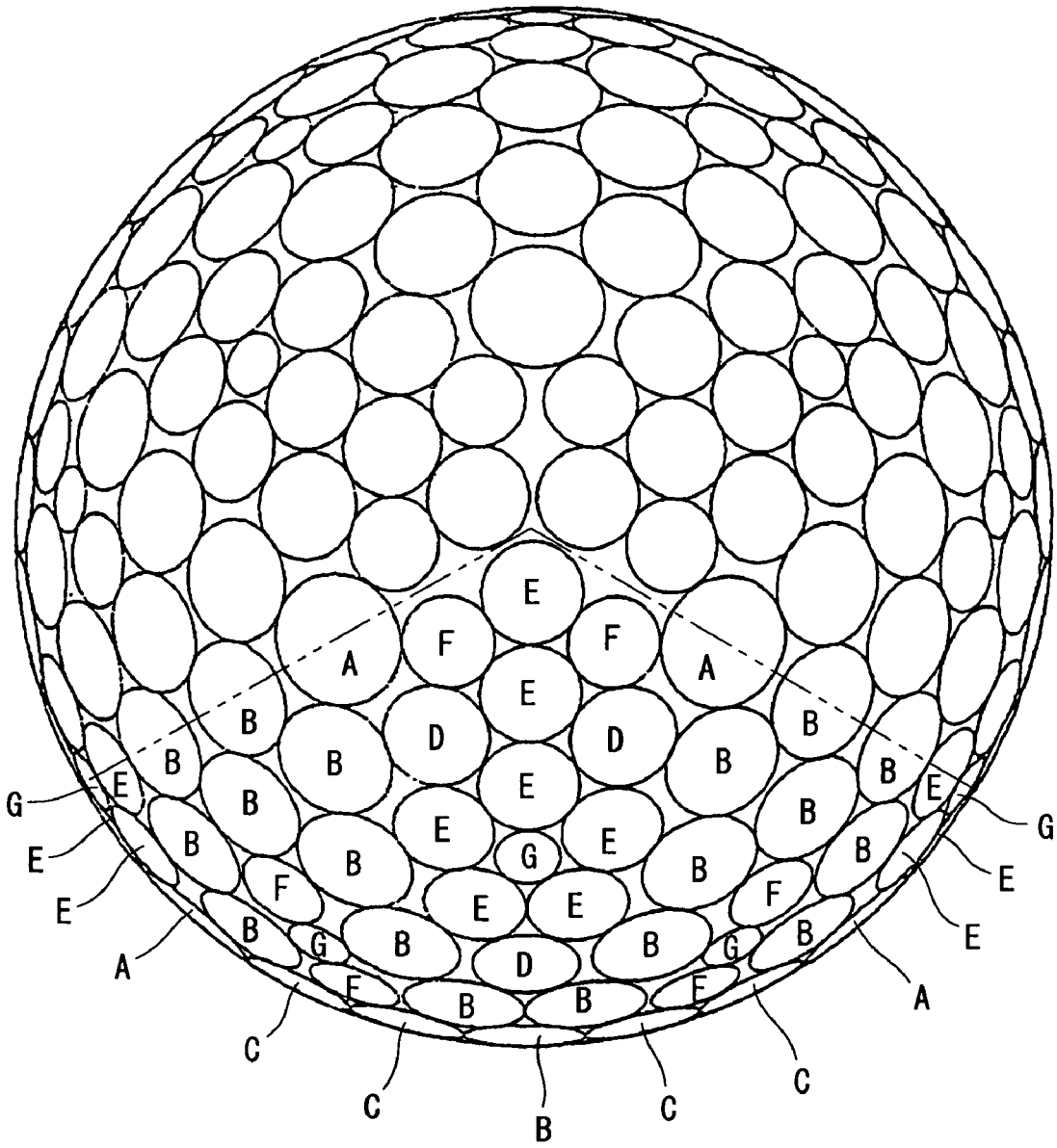
FIG. 13 is a plan view illustrating a golf ball according to Comparative Example 2.
Figure 14:
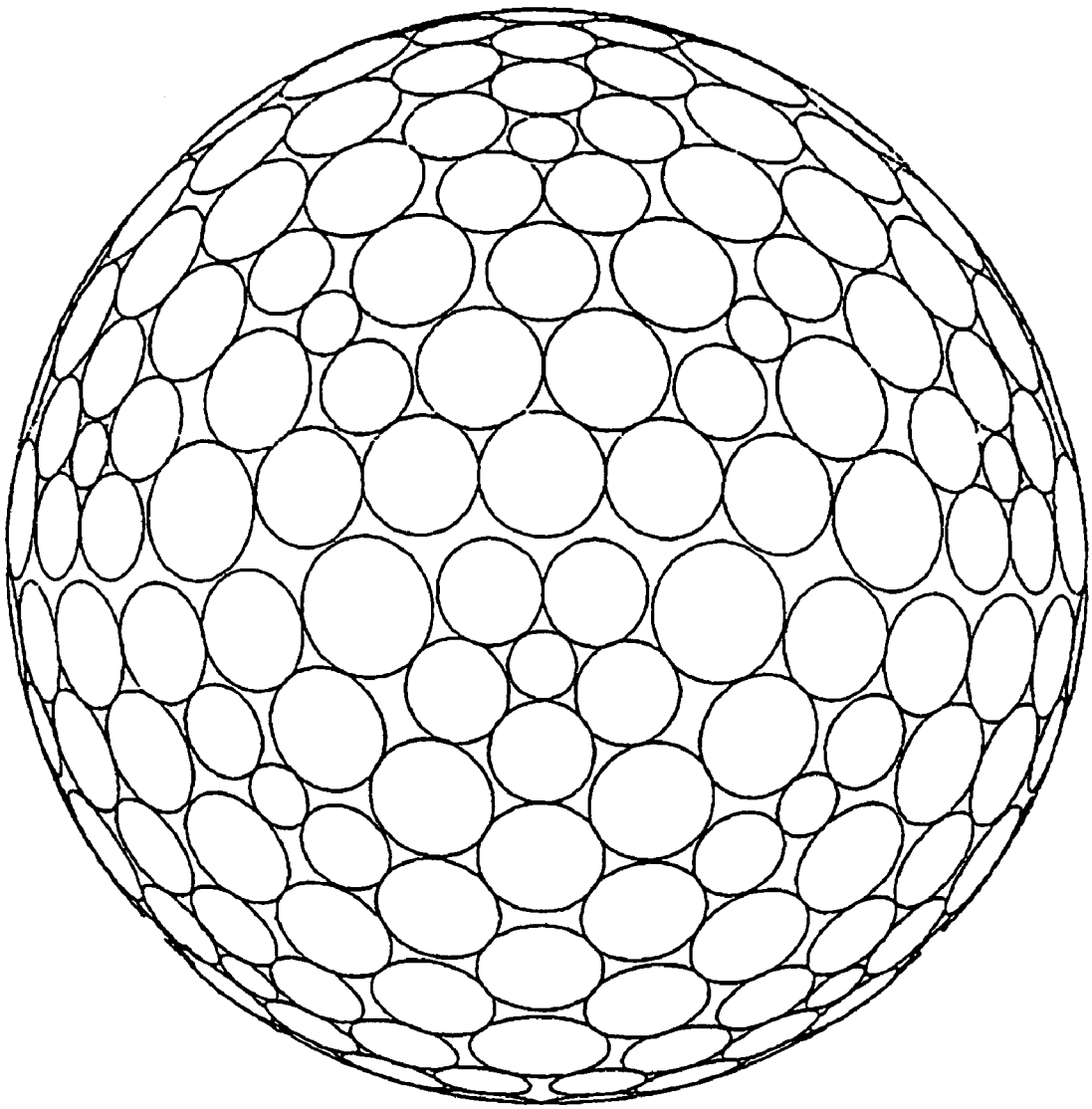
FIG. 14 is a front view illustrating the golf ball shown in FIG. 13.
Figure 15:
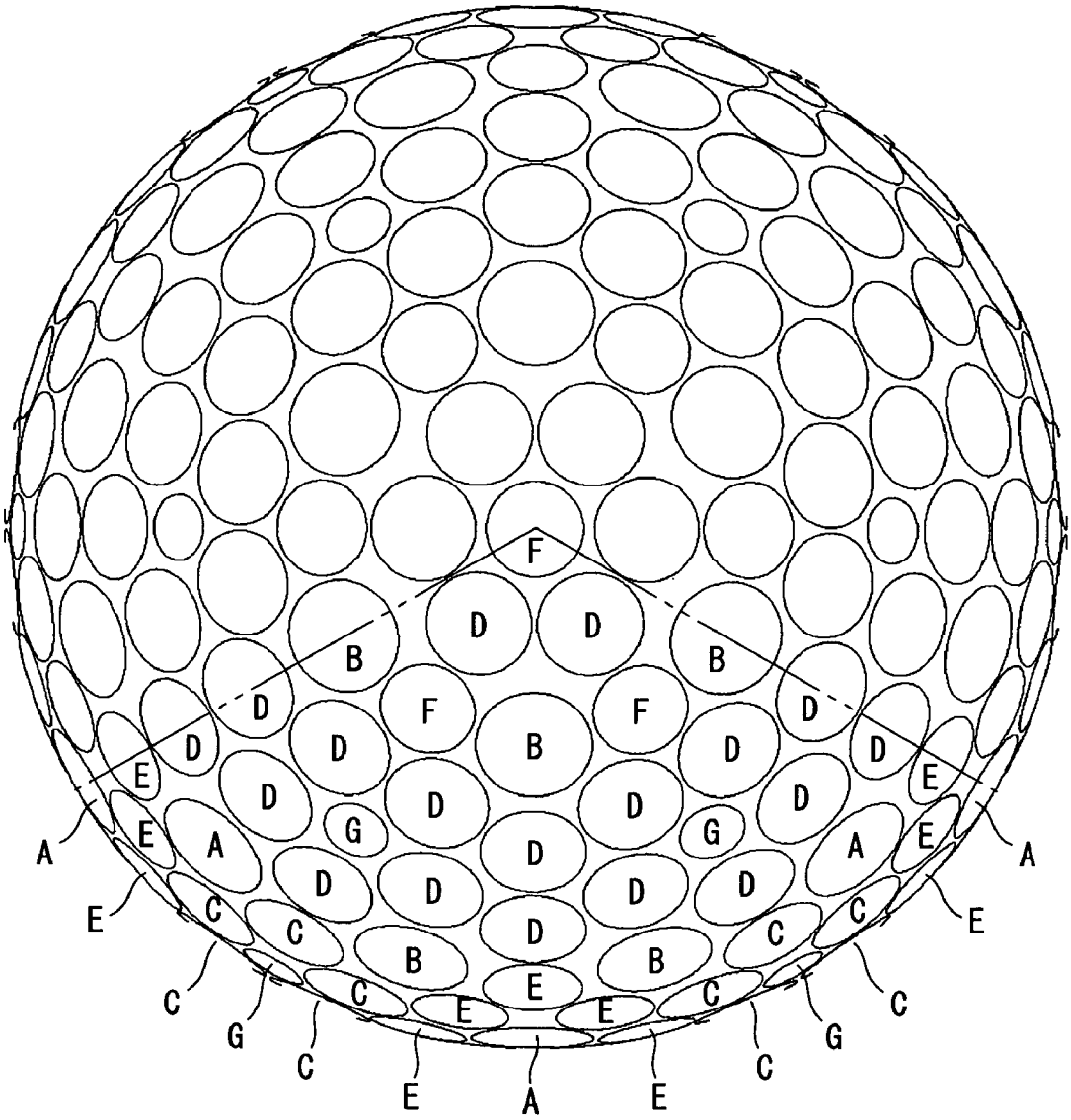
FIG. 15 is a plan view illustrating a golf ball according to Comparative Example 3.
Figure 16:
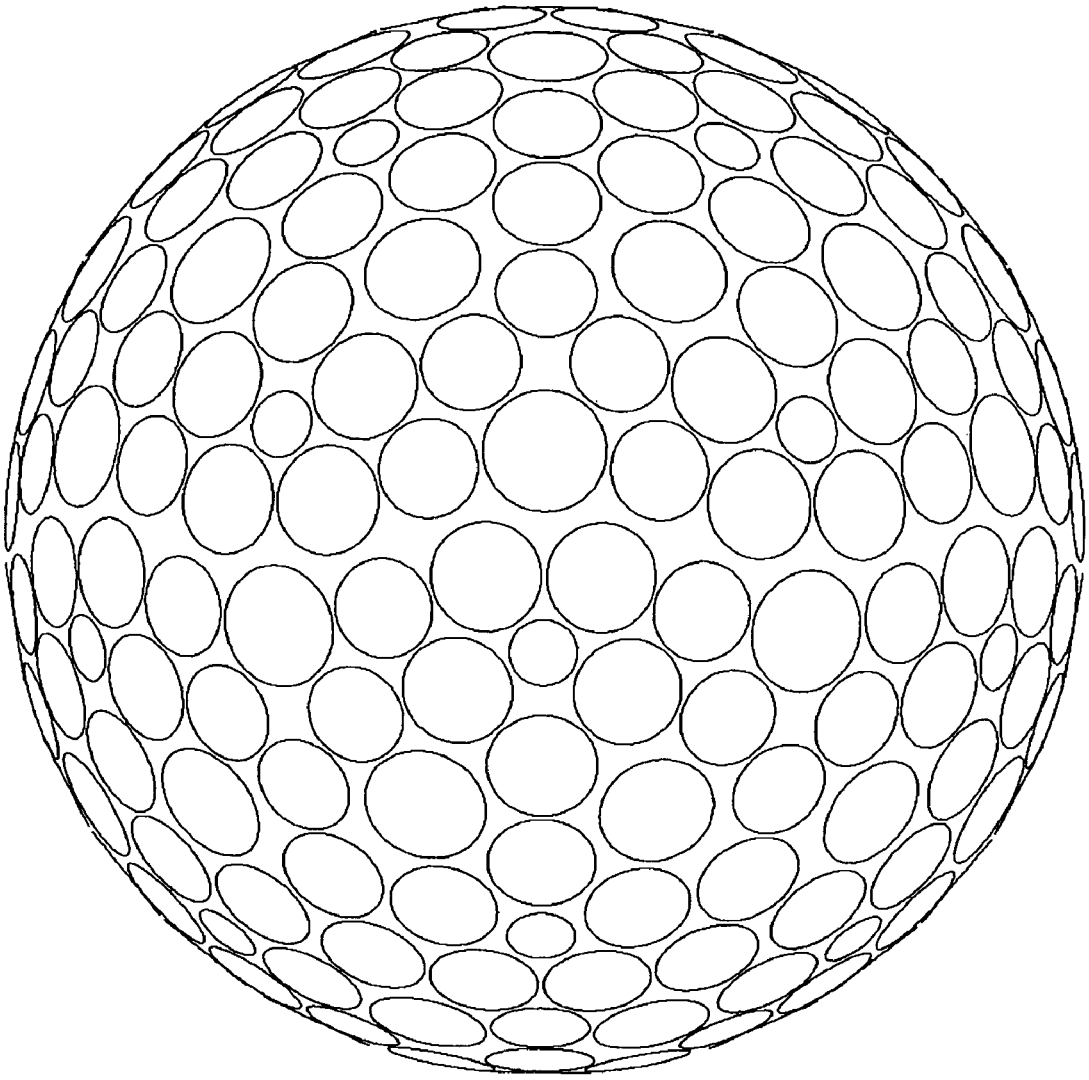
FIG. 16 is a front view illustrating the golf ball shown in FIG. 15.
Figure 17:
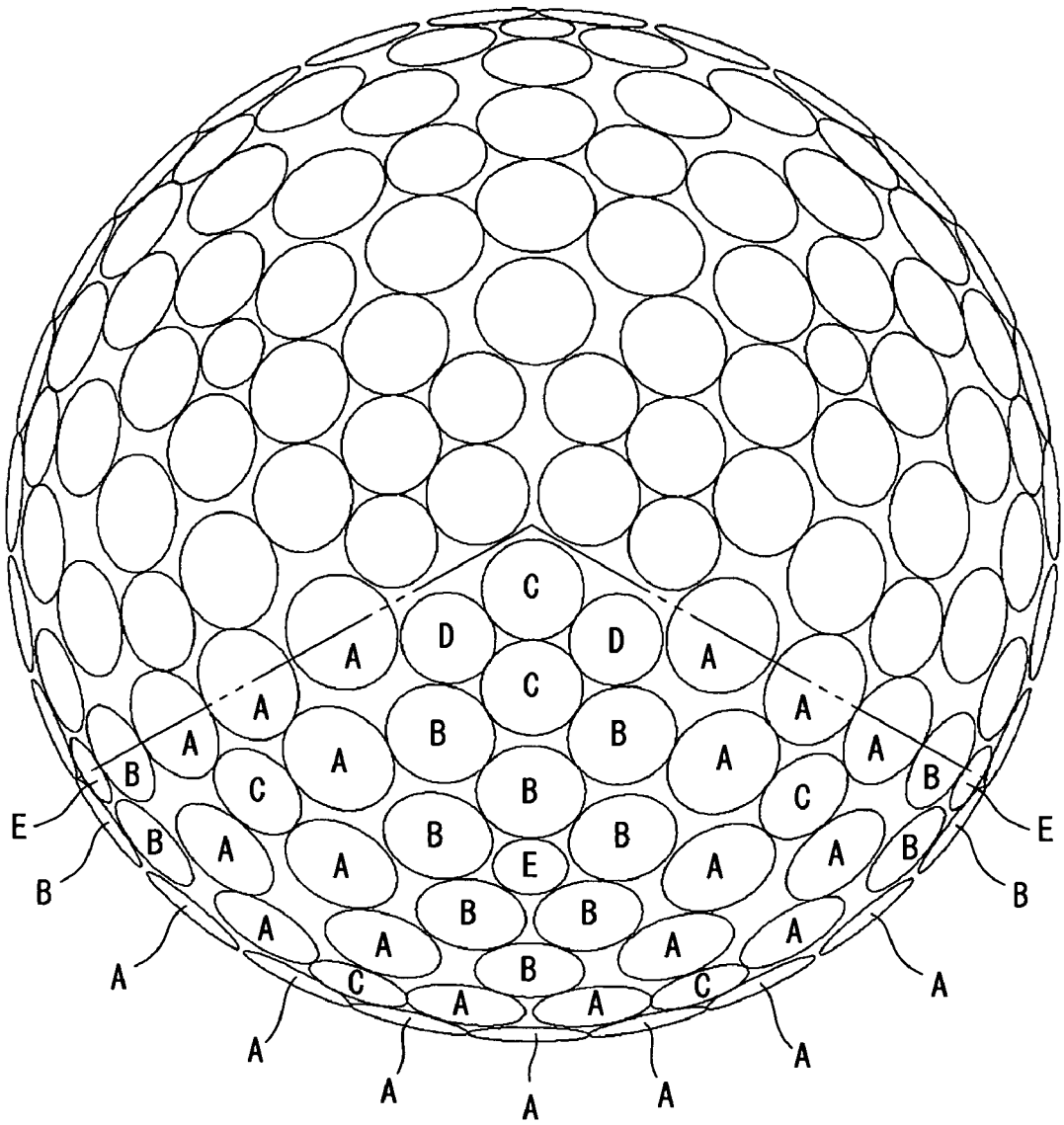
FIG. 17 is a plan view illustrating a golf ball according to Comparative Example 4.
Figure 18:
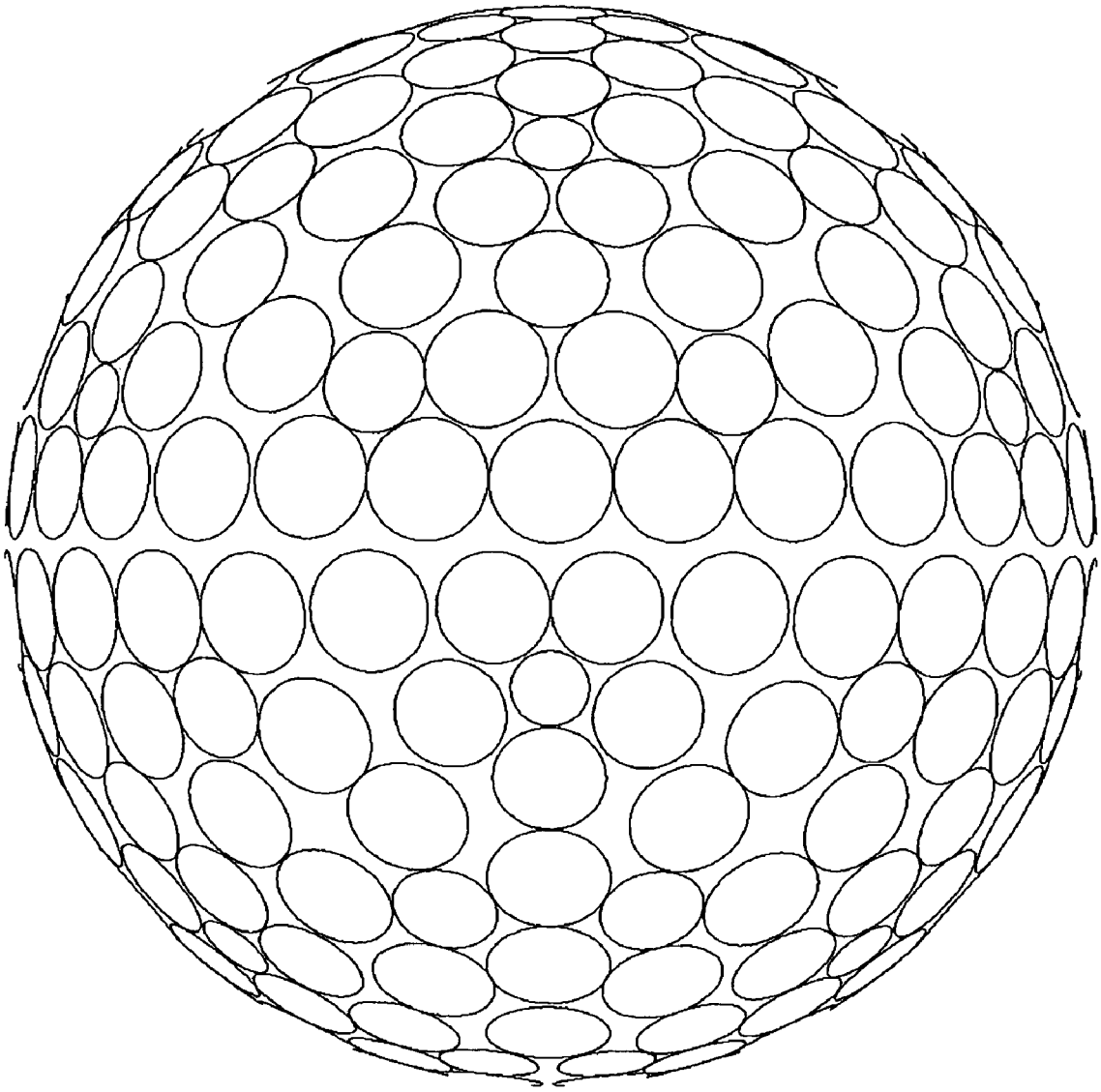
FIG. 18 is a front view illustrating the golf ball shown in FIG. 17.
Figure 19:
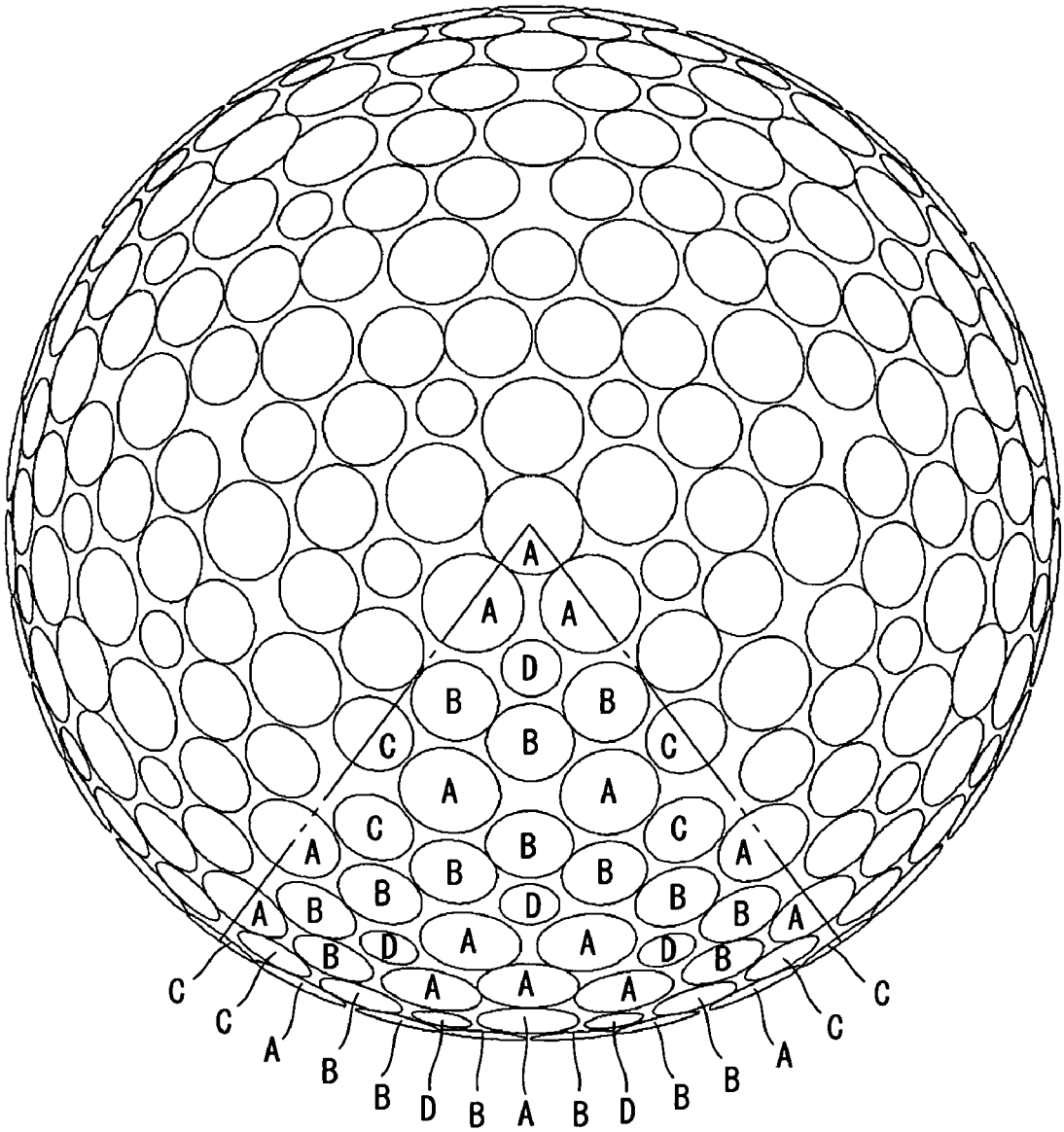
FIG. 19 is a plan view illustrating a golf ball according to Comparative Example 5.
Figure 20:
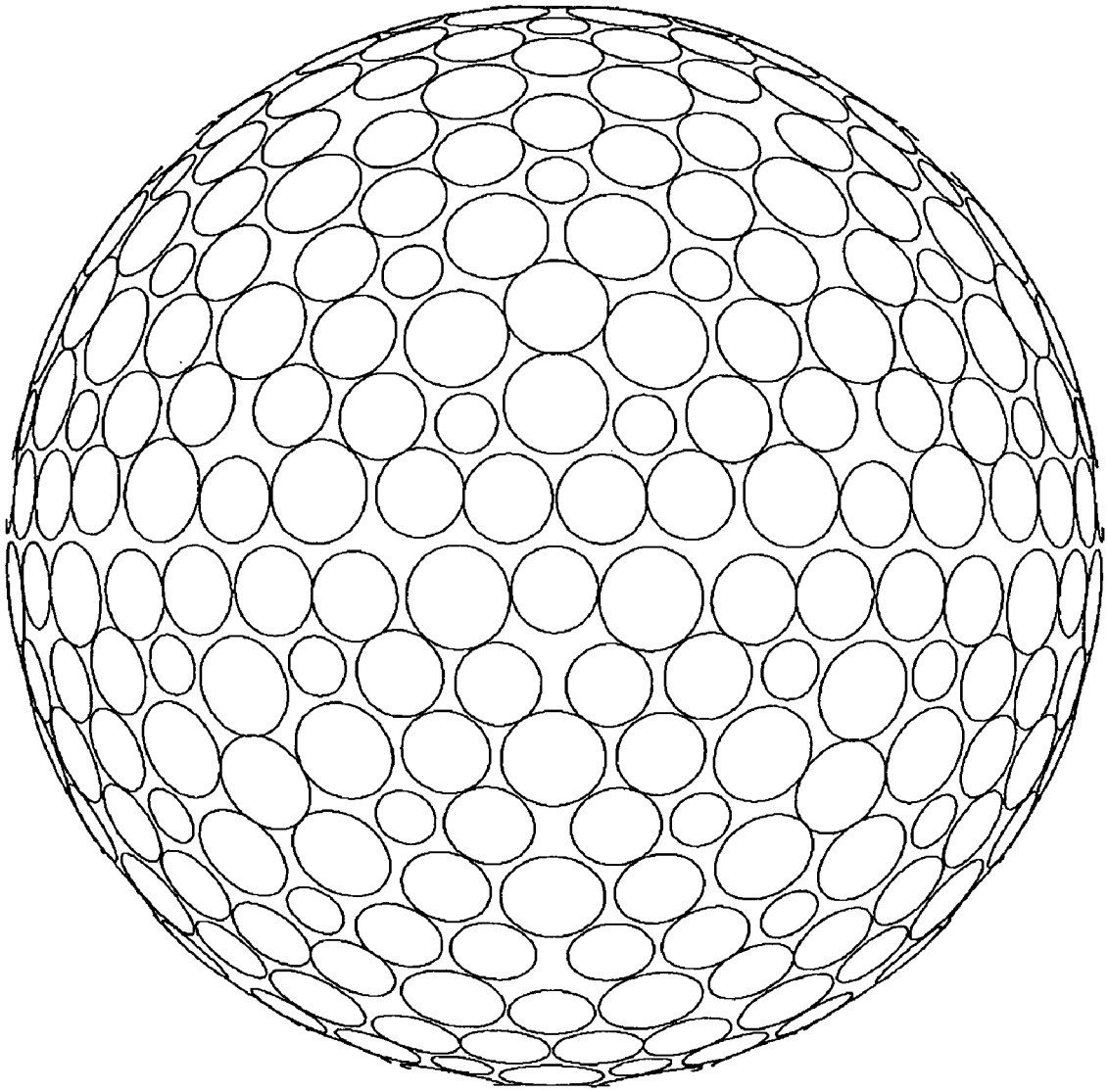
FIG. 20 is a front view illustrating the golf ball shown in FIG. 19.

| | Kind | Number | Diameter (mm) | Depth (mm) | Curvature radius (mm) | Volume ($mm^3$) | Plan view | Front view |
|---|---|---|---|---|---|---|---|---|
| Comp. example 1 | A | 192 | 4.50 | 0.141 | 18.02 | 1.123 | FIG. 11 | FIG. 12 |
| | B | 144 | 3.45 | 0.140 | 10.70 | 0.656 | | |
| Comp. example 2 | A | 18 | 5.60 | 0.131 | 29.99 | 1.614 | FIG. 13 | FIG. 14 |
| | B | 102 | 5.10 | 0.128 | 25.48 | 1.307 | | |
| | C | 24 | 4.85 | 0.128 | 23.00 | 1.185 | | |
| | D | 18 | 4.50 | 0.127 | 19.99 | 1.011 | | |
| | E | 72 | 4.25 | 0.126 | 18.05 | 0.891 | | |
| | F | 36 | 3.90 | 0.127 | 15.00 | 0.761 | | |
| | G | 24 | 2.75 | 0.127 | 7.50 | 0.379 | | |
| Comp. example 3 | A | 24 | 4.90 | 0.150 | 20.08 | 1.416 | FIG. 15 | FIG. 16 |
| | B | 24 | 4.70 | 0.150 | 18.48 | 1.303 | | |
| | C | 60 | 4.40 | 0.150 | 16.21 | 1.142 | | |
| | D | 96 | 4.30 | 0.145 | 16.01 | 1.054 | | |
| | E | 60 | 4.00 | 0.142 | 14.16 | 0.894 | | |
| | F | 14 | 3.90 | 0.140 | 13.65 | 0.838 | | |
| | G | 24 | 2.70 | 0.140 | 6.58 | 0.402 | | |
| Comp. example 4 | A | 132 | 4.95 | 0.137 | 22.42 | 1.320 | FIG. 17 | FIG. 18 |
| | B | 78 | 4.50 | 0.139 | 18.28 | 1.107 | | |
| | C | 36 | 4.20 | 0.137 | 16.16 | 0.950 | | |
| | D | 12 | 3.90 | 0.132 | 14.47 | 0.790 | | |
| | E | 12 | 3.10 | 0.130 | 9.31 | 0.492 | | |
| Comp. example 5 | A | 132 | 4.15 | 0.141 | 15.34 | 0.955 | FIG. 19 | FIG. 20 |
| | B | 180 | 3.55 | 0.141 | 11.24 | 0.699 | | |
| | C | 60 | 3.40 | 0.140 | 10.39 | 0.637 | | |
| | D | 60 | 2.45 | 0.140 | 5.43 | 0.331 | | |

[Travel Distance Test]

A driver having metal head (trade name "XXIO", available from Sumitomo Rubber Industries, Ltd.; shaft hardness: X, loft angle: 9°) was attached to a swing machine, available from True Temper Co. Then the golf ball was hit under the condition of the head speed being 49 m/sec, the launch angle being approximately 11° and giving the initial spin rate of approximately 3000 rpm. Accordingly, distance from the launching point to the point where the ball stopped was measured. Under the condition during the test, it was almost windless. Mean values of 20 times measurement are shown in Table 3 below.

TABLE 3

Results of evaluation

| | Example 1 | Example 2 | Example 3 | Example 4 | Comp. example 1 | Comp. example 2 | Comp. example 3 | Comp. example 4 | Comp. example 5 |
|---|---|---|---|---|---|---|---|---|---|
| Number of kinds of dimples | 8 | 7 | 6 | 5 | 2 | 7 | 7 | 5 | 4 |
| Total number of dimples | 314 | 302 | 300 | 300 | 336 | 294 | 302 | 270 | 432 |
| Total volume of dimples ($mm^3$) | 310.1 | 310.2 | 310.0 | 310.2 | 310.0 | 309.7 | 310.0 | 310.1 | 310.0 |
| Mean diameter of dimples (mm) | 4.26 | 4.41 | 4.32 | 4.34 | 4.05 | 4.53 | 4.19 | 4.59 | 3.56 |
| Occupation ratio (%) | 79.2 | 81.5 | 78.3 | 79.7 | 76.8 | 84.7 | 73.9 | 78.8 | 76.7 |
| Dx (mm) | 5.06 | 5.12 | 4.91 | 5.22 | 4.50 | 5.41 | 4.86 | 4.95 | 4.15 |
| Dn (mm) | 3.00 | 3.14 | 2.74 | 3.08 | 3.45 | 2.95 | 2.94 | 3.58 | 2.45 |
| Dx/Dn | 1.69 | 1.63 | 1.79 | 1.70 | 1.30 | 1.84 | 1.65 | 1.38 | 1.69 |
| η | 0.55 | 0.53 | 0.60 | 0.70 | 0.52 | 0.72 | 0.51 | 0.45 | 0.53 |
| Travel distance (m) | 240.1 | 238.0 | 239.2 | 238.6 | 234.9 | 236.1 | 235.5 | 235.8 | 234.0 |

As is shown in Table 3, the golf balls of Examples are excellent in the flight performance. Therefore, advantages of the present invention are clearly suggested by these results of evaluation.

The dimple pattern according to the present invention is suitable for not only two-piece golf balls, but also one-piece golf balls, multi-piece golf balls and wound golf balls. The description hereinabove is just for an illustrative example, therefore, various modifications can be made without departing from the principles of the present invention.

What is claimed is:

1. A golf ball having three or more kinds of dimples, each having a different diameter, on the surface thereof, said golf ball having an occupation ratio of total area of the dimples in the surface area of the phantom sphere being equal to or greater than 75%, a mean value of the diameter of all the dimples being equal to or greater than 4.00 mm, and a standard deviation η of the diameter of all the dimples being 0.52 or greater and 0.72 or less, and wherein a ratio (Dx/Dn) is equal to or less than 1.70, which is a ratio of a mean diameter of the dimples ranking in the top 10% Dx to a mean diameter of the dimples ranking in the bottom 10% Dn when all the dimples are arranged in decreasing order of the diameter.

2. The golf ball according to claim 1 having 5 or more kinds of dimples, each having a different diameter, on the surface thereof.

3. The golf ball according to claim 1 wherein the standard deviation $\eta$ is 0.55 or greater.

4. The golf ball according to claim 3 wherein the standard deviation $\eta$ is 0.60 or greater.

* * * * *